US008122935B2

(12) United States Patent
Kollotzek

(10) Patent No.: US 8,122,935 B2
(45) Date of Patent: Feb. 28, 2012

(54) CASTING CORE FOR FORMING A COOLING CHANNEL IN A PISTON PRODUCED BY CASTING

(75) Inventor: Helmut Kollotzek, Mutlangen (DE)

(73) Assignee: MAHLE International GmbH, Stuttgart (DE)

( * ) Notice: Subject to any disclaimer, the term of this patent is extended or adjusted under 35 U.S.C. 154(b) by 0 days.

(21) Appl. No.: 12/451,105

(22) PCT Filed: Apr. 25, 2008

(86) PCT No.: PCT/DE2008/000770

§ 371 (c)(1),
(2), (4) Date: Oct. 26, 2009

(87) PCT Pub. No.: WO2008/131754

PCT Pub. Date: Nov. 6, 2008

(65) Prior Publication Data

US 2010/0163203 A1 Jul. 1, 2010

(30) Foreign Application Priority Data

Apr. 27, 2007 (DE) ..... 10 2007 019 930
Sep. 15, 2007 (DE) ..... 10 2007 044 105

(51) Int. Cl.
*B22C 9/10* (2006.01)
*F01P 1/04* (2006.01)

(52) U.S. Cl. ..... 164/369; 164/348; 164/373; 123/41.35; 123/193.6; 92/186

(58) Field of Classification Search ..... 164/369, 164/373, 348; 123/41.35, 193.6; 92/186
See application file for complete search history.

(56) References Cited

U.S. PATENT DOCUMENTS 5,737,838 A 4/1998 Niimi et al.
2009/0025550 A1* 1/2009 Benz et al. ..... 92/186

FOREIGN PATENT DOCUMENTS

DE 71 18 607 8/1971

(Continued)

OTHER PUBLICATIONS

International Search Report.

*Primary Examiner* — Jessica L Ward
*Assistant Examiner* — Devang R Patel
(74) *Attorney, Agent, or Firm* — Collard & Roe, P.C.

(57) ABSTRACT

The invention relates to a soluble and essentially annular casting core (2) for forming a cooling channel that transitions into two areas (14, 15) which are approximately parallel to the piston axis (16) and are facing away from the piston head (3), via a respective bending of the core (17, 18) in the shape of a quadrant, wherein the second area (14) transitions into a part of the casting core (2) that forms the feed opening (12) of the cooling channel, and the first area (15) transitions into a part of the casting core (2) that forms the discharge opening (13) of the cooling channel. The two areas (14, 15) of the casting core (2) are disposed at a distance from one another, which corresponds at a maximum to two times the cross-sectional diameter of one of the two areas (14, 15). As a result, the throughflow of the cooling oil traversing the cooling channel is accelerated and the cooling of the piston improved.

3 Claims, 2 Drawing Sheets

FOREIGN PATENT DOCUMENTS

| | | | |
|---|---|---|---|
| DE | 195 10 050 | | 9/1996 |
| DE | 196 49 363 | | 6/1997 |
| DE | 196 50 930 | | 6/1998 |
| DE | 197 01 085 | | 7/1998 |
| DE | 102 18 998 | | 11/2003 |
| DE | 102 18 999 | | 11/2003 |
| DE | 103 25 916 | | 2/2004 |
| DE | 102 55 691 | | 6/2004 |
| DE | 299 24 794 | | 9/2005 |
| DE | 10 2004 056 870 | | 6/2006 |
| JP | 2006-090159 | | 4/2006 |
| JP | 2006090159 A | * | 4/2006 |

* cited by examiner

CASTING CORE FOR FORMING A COOLING CHANNEL IN A PISTON PRODUCED BY CASTING

CROSS REFERENCE TO RELATED APPLICATIONS

This application is the National Stage of PCT/DE2008/000770 filed on Apr. 25, 2008, which claims priority under 35 U.S.C. §119 of German Application No. 10 2007 019 930.0 filed on Apr. 27, 2007 and German Application No. 10 2007 044 105.5 filed on Sep. 15, 2007. The international application under PCT article 21(2) was not published in English.

The invention relates to a casting core for forming a cooling channel in a piston produced by casting, in accordance with the preamble of claim 1.

A water-soluble salt casting core for forming a cooling channel in a cast piston for an internal combustion engine is known from the Japanese patent application having the publication number 2006090159 A, which core is configured to be ring-shaped and has a region that lies parallel to the piston axis, which forms the oil run-off of the cooling channel and makes a transition into the ring-shaped part of the cooling channel by way of a quarter-circle core bend. Furthermore, the salt core has a region disposed parallel to the piston axis, which forms the oil run-in of the cooling channel, whereby the salt core has a notch on the side that lies opposite this region, to form a jet splitter that narrows conically in the direction of the injected oil jet. The jet splitter has the function of dividing the oil jet up into the halves of the cooling channel that lie on both sides of it, whereby the division of the cooling oil into the two cooling channel halves depends both on the position of the piston relative to an oil nozzle that issues the oil jet, and on crosswise accelerations that the oil jet experiences due to movements of the engine equipped with the piston. From this, the disadvantage results that the amount of cooling oil that is introduced into the halves of the cooling channel that lie on both sides of the jet splitter is subject to great variations, which can result in temperature problems for the piston that can lead to damage to the engine equipped with the piston.

It is the task of the invention to avoid this disadvantage of the state of the art. This task is accomplished with the characteristics standing in the characterizing part of the main claim. Practical embodiments of the invention are the object of the dependent claims.

Figure 2:
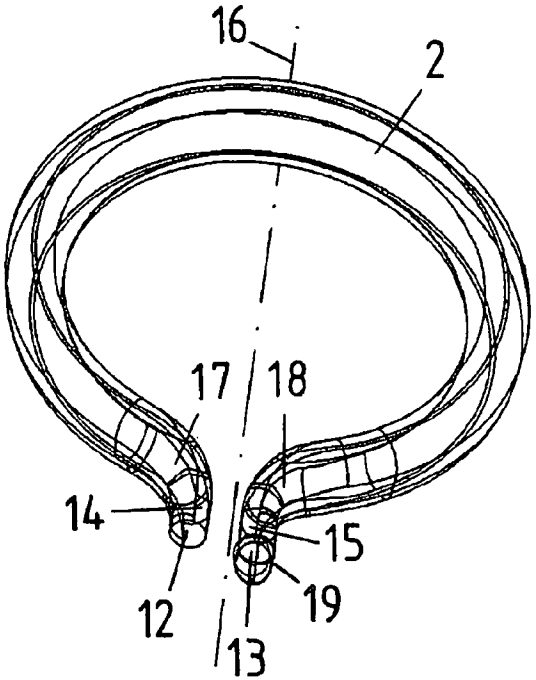
Figure 1:
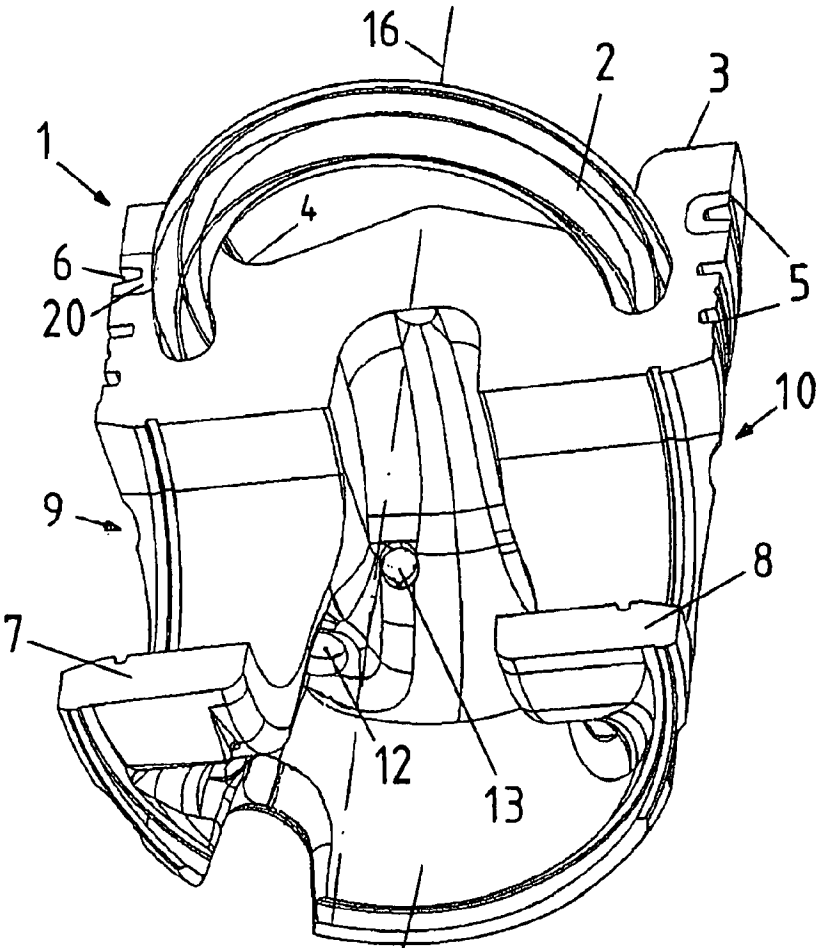
Figure 4:
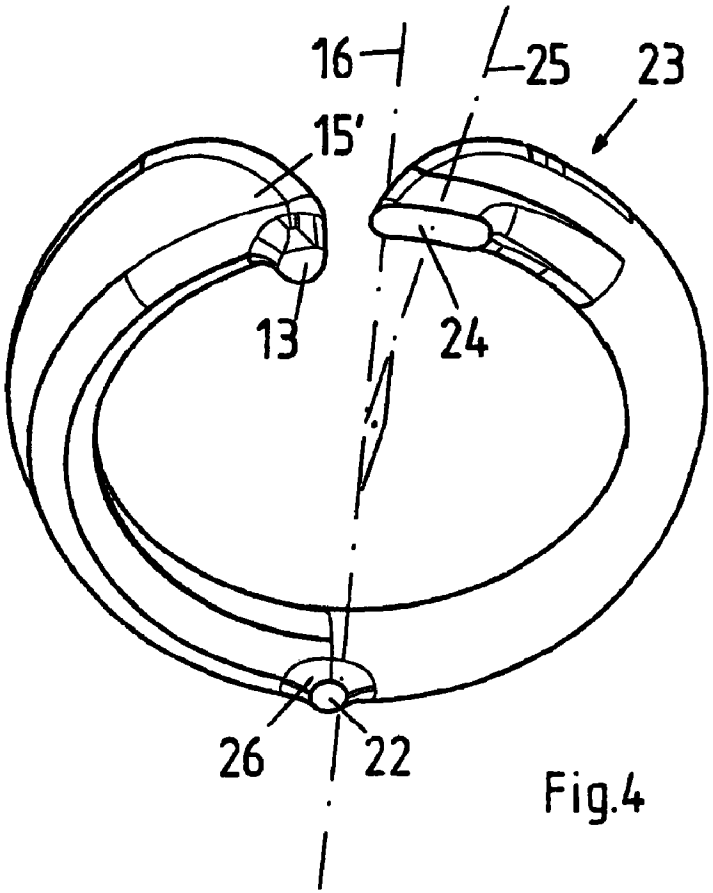
Figure 3:
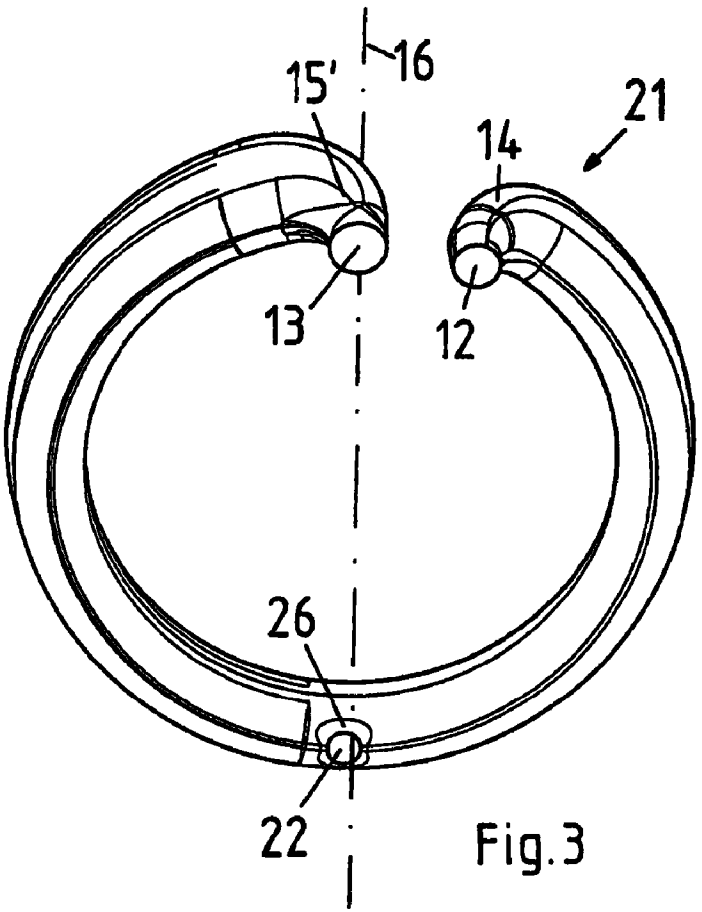

An exemplary embodiment of the invention will be described in the following, using the drawings. These show:

FIG. 1 a perspective representation of a piston produced using the casting process, half in section, using the soluble casting core according to the invention to form a cooling channel, FIG. 2 the soluble casting core according to the invention in a perspective representation, before it is laid into a casting mold for the piston, FIG. 3 an embodiment of the casting core, having two oil run-off openings and a cross-section that increases in the direction of the main run-off opening, and FIG. 4 another embodiment of the casting core, having an oval run-in opening.

FIG. 1 shows, in a perspective representation, a piston 1 for an internal combustion engine, half in section, which piston is produced using the casting method, whereby a casting core 2 produced from a material that can be dissolved out is also cast in. In FIG. 1, the casting core 2 is shown completely; it is configured in ring shape and is disposed close to the piston crown 3, in the radially outer region of the piston 1. The piston 1 can be produced from aluminum or from cast iron, while the soluble casting core 2 can consist of salt or of sand, so that after the piston 1 has been cast, the casting core 2 can be washed out of the piston 1 with water or with another suitable liquid.

The piston 1 is provided with a combustion bowl 4 formed into the piston crown 3, and with a ring belt 5, radially on the outside, in the vicinity of the piston crown, whereby the groove 6 that lies closest to the piston crown 3 has a ring insert 20, for example consisting of Niresist, for a compression ring not shown in the drawing. The piston 1 furthermore has two pin bosses 7, 8 that lie opposite one another, on the side of the piston 1 that faces away from the piston crown 3, each having a pin bore 9, 10, and furthermore skirt elements that connect the pin bosses 7, 8 with one another and are formed onto the piston crown 3, of which only the skirt element 11 is visible in the representation of the piston 1 according to FIG. 1.

The piston 1 shown in FIG. 1 is cut open in such a way that the run-in opening 12 and main run-off openings 13 of the cooling channel, formed by the casting core 2, can be seen. FIG. 2 shows that the casting core 2 has short regions 14, 15 both in the region of the run-in opening 12 and in the region of the main run-off opening 13, which regions have at least approximately the same cross-section diameter, and which make a transition into the ring-shaped part of the casting core 2 by way of a core bend 17, 18 in the shape of a quarter circle, in each instance. In this connection, the region 14, which forms the run-in opening 12, lies at least approximately parallel to the piston axis 16. The two regions 14 and 15 of the casting core 2 are disposed at a slight distance from one another, which approximately corresponds, in the present exemplary embodiment, to the cross-section diameter of the region 14 or 15, but maximally to twice the cross-section diameter of the region 14 or 15. In this connection, the second region 14 runs into that end of the casting core 2 that forms the run-in opening 12 of the cooling channel.

In the region of the main run-off opening 13 of the cooling channel, the casting core 2 can have another core bend 19, by way of which the first region 15 of the casting core 2 that lies parallel to the piston axis 16 makes a transition into the part of the casting core 2 that forms the main run-off opening 13, which is oriented in such a way, in this connection, that the cooling oil that exits from it, as can be seen in FIG. 1, spurts in the direction of a piston pin not shown in FIG. 1. In this way, the cooling oil can be used, after cooling the piston 1, to cool the pin of the piston 1, and to lubricate the small connecting rod end of a connecting rod that is connected with the piston.

In this connection, the shape of the casting core 2 in the region of the run-in opening 12 and in the region of the main run-off opening 13, with the regions 14 and 15 that lie parallel to the piston axis 16, and with the core bends 17 and 19, has the advantage that cooling oil can be injected into the oil run-in opening 12 formed by the casting core 2 under high pressure, independent of the position of the piston 1 in an oil injection nozzle disposed in the region of the crankshaft, for example, whereby the oil injection nozzle is disposed in such a manner that it sprays out the cooling oil parallel to the piston axis 16 and, in doing so, injects it into the run-in opening 12. The oil then gets into the ring-shaped part of the oil channel by way of the part of the cooling channel formed by the core bend 17, with only slight flow resistance, passes through this part quickly, and gets to the main run-off opening 13 by way of the parts of the cooling channel formed by the core bends 18 and 19, with little flow resistance, so that in this way, a large oil throughput is guaranteed, which leads to improved cooling of the piston 1 as compared with the state of the art.

Furthermore, the slight distance between the parts of the cooling channel that are formed by the regions 14 and 15 of the casting core 2 that lie parallel to the piston axis 16 has the advantage that only a very slight part of the piston 1 remains uncooled by the cooling oil.

The exemplary embodiment of a casting core 21 shown in FIG. 3, in comparison with the casting core 2 according to FIG. 2, has a center region 26 that faces away from the piston crown 3, which forms a central run-off opening 22, and which is disposed on the side of the casting core 21 that lies opposite the regions 14 and 15' for the run-in opening 12 and for the main run-off opening 13. Furthermore, the cross-section of the casting core 21 increases, proceeding from its center region 26, to its first region 15' that forms the run-off opening 13. In this connection, the cross-section of the entire casting core 21 has an oval shape, the ovality of which lies in the direction of the piston axis 16. The cooling channel formed by the casting core 21 has the advantage that because of the additional, central run-off opening 22 and because of the cross-section that increases in the direction of the first region 15', it offers very little flow resistance to the cooling oil introduced into the run-in opening 12, so that as a result, the amount of the cooling oil passed through the cooling channel increases further, and cooling of the piston 1 is improved.

FIG. 4 shows an embodiment of a casting core 23 whose run-in opening 24 is configured in oval shape, whereby its ovality lies perpendicular to the piston radius 25. This brings with it the advantage that the oil injection nozzle, which is disposed in the region of the crankshaft, and by the aid of which the cooling oil is passed to the cooling channel piston, does not have to be oriented in such a way that it sprays oil exclusively parallel to the piston axis 16. The cooling oil can be sprayed at a slant, in other words at an acute angle to the piston axis 16, in the direction of the run-in opening 24, as a function of the location where the oil injection nozzle is installed, whereby the oil injection nozzle must be oriented in such a manner that the oil jet hits the run-in opening 24 independent of the position of the piston 1 between the upper and lower dead-center position.

REFERENCE SYMBOL LIST

1 piston
2 casting core
2 casting core
3 piston crown
4 combustion bowl
5 ring belt
6 groove
7, 8 pin boss
9, 10 pin bore
11 skirt element
12 run-in opening
13 main run-off opening
14 second region of the casting core 2
15 first region of the casting core 2
15' first region of the casting core 23
16 piston axis
17, 18, 19 core bend
20 ring insert
21 casting core
22 central run-off opening
23 casting core
24 run-in opening
25 piston radius
26 center region of the casting core 23

The invention claimed is:

1. An assembly comprising:

a piston including a piston crown and having an axis through the center of the piston and in a longitudinal direction of both the piston and the piston crown;

a ring-shaped soluble casting core for forming a cooling channel for accommodating cooling oil in the piston produced using casting technology, close to the piston crown, wherein the casting core has a core bend in the shape of quarter circle and makes a transition into a first region disposed at least approximately parallel to the piston axis and facing away from the piston crown, which region forms a main run-off opening of the cooling channel, wherein the casting core has a second core bend in the shape of a quarter circle and makes a transition into a second region that is disposed approximately parallel to the piston axis and faces away from the piston crown, which region forms the run-in opening of the cooling channel, and wherein the first and the second region of the casting core have at least approximately the same cross-sectional diameter, and are disposed at a distance from one another that corresponds to between once and twice the cross-sectional diameter of one of the two regions.

2. The assembly according to claim 1, further comprising a central region that lies opposite the first and second regions, said central region facing away from the piston crown and forming a central run-off opening.

3. The assembly according to claim 2, wherein the cross-section of the casting core, proceeding from the central region, increases to the first region.

* * * * *